United States Patent [19]

Zendron

[11] 4,306,645

[45] Dec. 22, 1981

[54] ARRANGEMENT TO BE USED FOR CONTROLLING THE QUANTITY AND PERIOD OF CHARGING OF PITCH COKE FURNACES

[75] Inventor: Johann Zendron, Linz, Austria

[73] Assignee: Voest-Alpine Aktiengesellschaft, Linz, Austria

[21] Appl. No.: 172,830

[22] Filed: Jul. 28, 1980

[30] Foreign Application Priority Data

Sep. 14, 1979 [AT] Austria ..... 6054/79

[51] Int. Cl.[3] ..... C10G 7/00

[52] U.S. Cl. ..... 196/120; 196/127; 196/132; 196/135; 202/121; 202/262

[58] Field of Search ..... 196/120, 127, 128, 106, 196/132, 135, 136; 202/160, 121, 150, 262; 73/296, 433, 435, 336

[56] References Cited

U.S. PATENT DOCUMENTS

| | | | |
|---|---|---|---|
| 1,464,246 | 8/1923 | Freeman | 196/106 |
| 1,742,888 | 1/1980 | Wolf | 196/127 |
| 2,165,587 | 7/1939 | Sweeny | 196/127 |
| 4,080,014 | 3/1978 | Riegler et al. | 308/6 R |
| 4,176,052 | 11/1979 | Brue et al. | 202/121 |

FOREIGN PATENT DOCUMENTS

| | | | |
|---|---|---|---|
| 632477 | 6/1936 | Fed. Rep. of Germany . | |
| 1061290 | 2/1957 | Fed. Rep. of Germany . | |
| 2020045 | 11/1979 | United Kingdom | 73/296 |

*Primary Examiner*—Hiram Bernstein
*Attorney, Agent, or Firm*—Brumbaugh, Graves, Donohue & Raymond

[57] ABSTRACT

An arrangement is provided for controlling the quantity and period of charging of pitch coke furnaces whose pitch supply conduits are connected to a heatable ring conduit and are in connection with at least one pitch reservoir via this ring conduit. In the pitch supply conduits, pitch dosing containers are arranged, which containers rest on bearing-pressure measuring means. Via these bearing-pressure measuring means, the respective filling level of the pitch dosing containers is determinable.

5 Claims, 4 Drawing Figures

ARRANGEMENT TO BE USED FOR CONTROLLING THE QUANTITY AND PERIOD OF CHARGING OF PITCH COKE FURNACES

BACKGROUND OF THE INVENTION

The invention relates to an arrangement for controlling the quantity and period of controllable charging of pitch coke furnaces whose pitch supply conduits are connected to a heatable ring circuit and are in connection with at least one pitch reservoir via this ring circuit.

Into pitch coke furnaces there are poured liquid pitches having a softening point according to Krämer-Sarnow (SKS) of about 150° C. These pitches have such a viscosity that they are difficult to convey, tending to foam and to solidify immediately upon cooling, so that pumps and pipelines for distributing the pitch have to be appropriately adapted to these circumstances. In particular, pitch supply conduits have to be laid in such a manner that they can be flushed with overheated steam at certain time intervals in order to prevent obstructions.

The pouring or charging of pitch into the pitch coke furnaces has to be effected in accurately measured amounts and over certain periods of time, since otherwise a too intense degassing and foam formation would occur within the furnace, thus leading to what is called "pressing" of the furnaces. In case of a pressing of the furnace, pitch will penetrate both into the gas take-off main and out of the filling pipes and doors. At the same time, this procedure also involves the formation of pitch vapors which results in considerable difficulties, i.e. operational disturbances as well as negative effects on the environment and on health.

Owing to the tendency of the pitches to foam, the necessary accuracy is not achieved with the quantitative measurements carried out previously by means of floats or filling level measuring means using radioactive preparations. Also, known flow meters are not suitable for this purpose.

SUMMARY OF THE INVENTION

The invention has as its object to provide an operationally safe supply arrangement for pitch coke furnaces, with the help of which, a far more accurately controllable charging of the pitch coke furnaces is made possible than by the arrangements known so far. This arrangement is not sensitive to the formation of foam and gas, thus pressing of the pitch coke furnaces and solidification of the pitch is prevented to a major extent and the environmental load caused by the pitch vapors is reduced.

This object is achieved in a filling plant or arrangement of the initially-defined kind in that, in the pitch supply conduits, pitch dosing containers are provided, which are mounted on bearing-pressure measuring means via which the respective filling level of the pitch dosing containers is determinable.

According to one embodiment, the pitch dosing containers with their bearing-pressure measuring means are mounted on movable filling cars.

For providing a system that is pitch-vapor-tight towards the exterior, it is particularly suitable if the gas-containing space of the pitch dosing containers is in connection with a pressure conduit comprising a pressure regulating valve and conducting steam or an inert gas.

For increasing the operational safety it is advantageous, according to a further embodiment, if the gas-containing space of the pitch dosing containers is connected via a vapor conduit with a vapor tower in whose upper section a flushing-water shower is provided.

As bearing-pressure measuring means an electromechanical bearing-pressure measuring cell is installed. By means of this cell the pitch charge can be precisely followed via an optical indicator or via a co-running measuring tape.

BRIEF DESCRIPTION OF THE DRAWINGS

The arrangement according to the invention will now be explained in more detail with reference to the accompanying drawings, wherein.

DESCRIPTION OF ILLUSTRATIVE EMBODIMENTS

Figure 1:
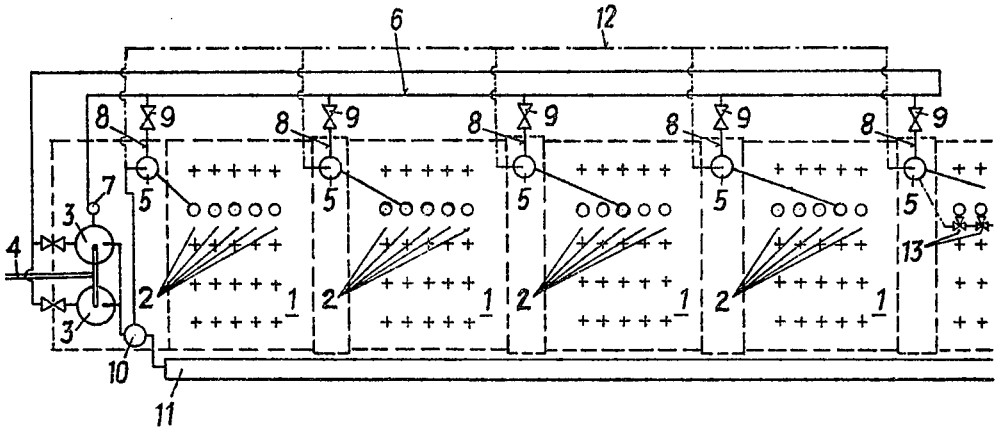
FIG. 1 is a schematic illustration of an arrangement according to the invention comprising pitch coke furnaces combined in individual batteries.

The arrangement according to FIG. 1 comprises five batteries 1 of pitch coke furnaces 2, each battery including five pitch coke furnaces having five openings each. At one end of the battery row there are pitch reservoirs 3 provided with a pitch supply conduit 4. From the reservoirs pitch dosing containers 5 are supplied via a heatable pitch circulation conduit (ring conduit) 6 in which a pump 7 is installed. Supply conduits 8, which run from the circulation conduit 6 via the dosing containers to the filling openings of the pitch coke furnaces, include valves or locking organs 9. The pitch dosing containers are mounted on bearing-pressure measuring means, e.g. electromechanical load measuring cells, which constantly indicate the weight of the pitch in the containers.

The gas-containing spaces (free spaces) of the pitch dosing containers 5 and those of the pitch reservoirs 3 are connected, via a vapor conduit 12, with a vapor tower 10 and a gas take-off main 11. In the take-off main the gases forming in the furnaces are collected.

The pitch supply conduits 8 either are laid so as to be fixed in place and provided with valves or locking organs 13, or the necessary pipeline sections are moved to the individual furnaces as required.

Figure 2:
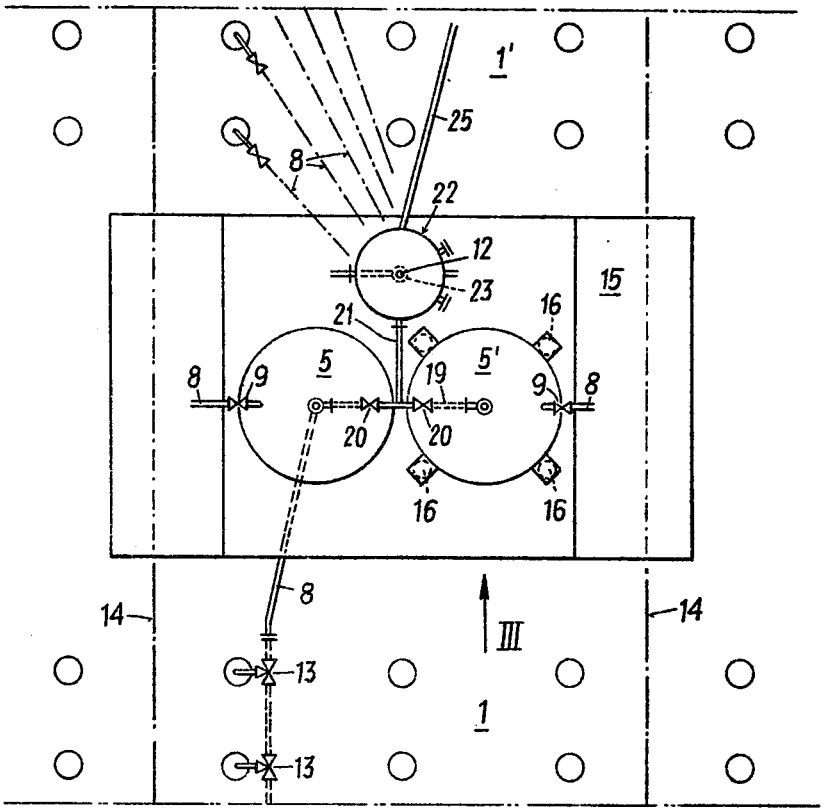
FIG. 2 shows a detail of one embodiment of the arrangement according to the invention in the top view.
Figure 3:
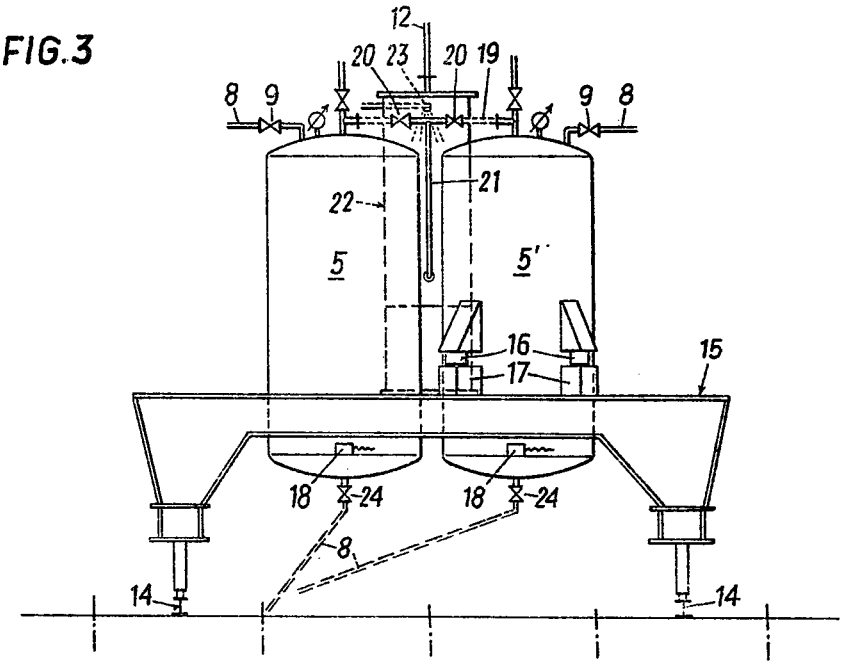
FIG. 3 is a view of the filling car represented in FIG. 2 from the direction III.

In FIG. 2 two batteries 1 and 1' of pitch coke furnaces are illustrated, between which batteries a filling car 15 movable on rails 14 is arranged. The filling car carries two pitch dosing containers 5, 5', which are mounted on bearing-pressure measuring means 16. The supports 17 for the bearing-pressure measuring means are connected with the filling car 15 (FIG. 3). In the lower part of the dosing containers there are thermocouples 18 for controlling the temperature of the container contents. The gas-containing spaces of the two pitch-dosing containers are in connection with each other via a conduit 19 containing valves or locking organs 20. Into conduit 19 a further vapor conduit 21 also enters, which conduit 21 is connected to a vapor tower 22 also arranged on the filling car 15. From the vapor tower 22 a vapor conduit 12 leads the flushed vapors into the open air and the flushing water is conducted away to the gas take-off main 11.

Within the vapor tower 22, flushing-water shower 23 is provided in the upper section thereof. Running into the upper lid of the dosing container 5, 5', are the supply conduits 8 that lead from the pitch circulation conduit 6 and contain the locking organs 9.

From the lowest point on the dosing containers 5, 5', pivotably designed elongation pieces of the furnaces supply conduits 8 lead to the filling openings of the pitch coke furnaces via locking organs 24. For the furnace battery 1, stationary supply conduits including locking organs 13 (FIGS. 1, 2) are illustrated, while battery 1' is charged from dosing containers 5' by means of exchangeable conduits 8 (FIG. 2).

Figure 4:
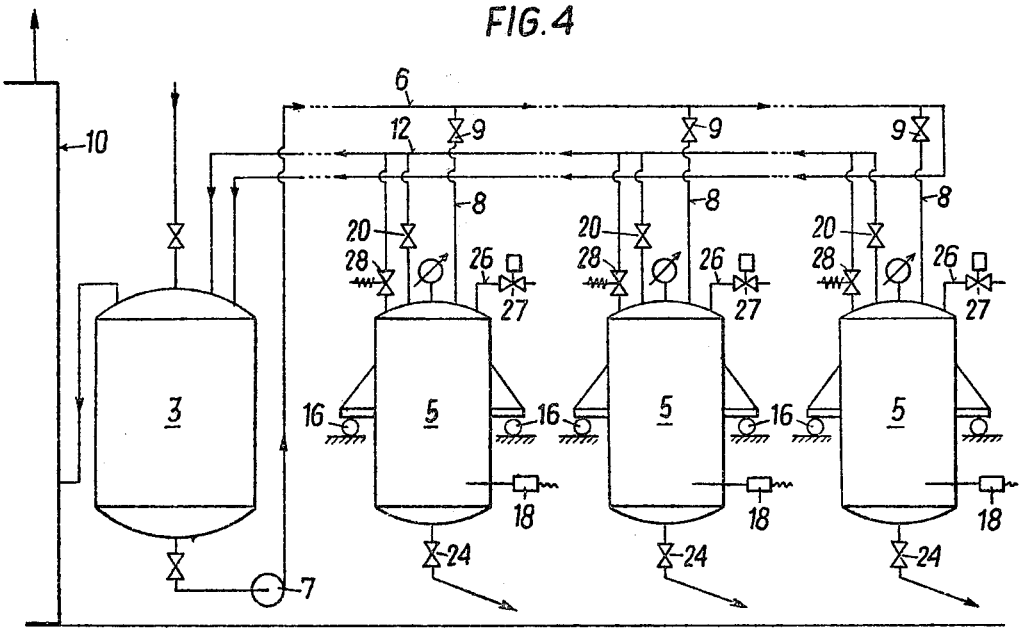
FIG. 4 is a scheme of a preferred embodiment of the arrangement, comprising pressure conduits leading to the pitch dosing containers.

FIG. 4 schematically illustrates three pitch dosing containers 5 resting on bearing-pressure measuring means 16, into whose upper lids pressure conduits 26 run, which conduits include pressure regulating valves 27. The individual dosing containers in turn are connected, via the supply conduits 8 that include one locking organ 9 each, to the heatable pitch circulation conduit 6, through which pitch is constantly led in circulation from reservoir 3 by means of circulation pump 7. Each pitch dosing container comprises an overpressure regulating valve 28 and is in connection with pitch reservoir 3 via pitch vapor conduit 12 in which locking organs 20 are installed. The gas-containing space of the pitch reservoir is connected to vapor tower 10 via a further conduit. In the vicinity of the bottom of the pitch dosing containers thermocouples 18 are installed. Also elongation pieces of the furnace supply conduits lead from the center of the bottom to the pitch coke furnaces via locking organs 24.

The plant according to the invention functions in the following manner: From the reservoirs 3 liquid pitch is supplied to the dosing containers 5 via the heatable pitch circulation conduit 6. The amount filled or poured into each container is indicated by means of the bearing-pressure measuring means 16; the desired final pitch level being automatically indicated by an electric signal delivered from the bearing-pressure measuring means 16. The locking organ 9 is automatically closed when the desired amount of pitch has been reached and the pitch in conduit 6 constantly remains in circulation and is directed towards the other dosing containers and the reservoirs. The circulation of the pitch is effected by the pump 7.

The vapor tower 22 serves for increasing the operational safety of the plant since it is in contact with the vapor-containing spaces of the entire plant. It also includes a connection 25 for possible suction of pressing furnaces. In the interior of the vapor tower 22, a flushing-water shower 23 is illustrated. Upon the sudden occurrence of pitch vapors in one part of the plant, the overheated vapors are cooled in the vapor towers by using the flushing water, and the vapors are thus partly condensed.

In the embodiment according to FIG. 4, the liquid pitch also is constantly held in circulation by the heated ring conduit 6.

In order to fill the pitch dosing containers, the locking organs 9 as well as 20 are opened, whereby the pitch can stream from conduit 8 into the dosing containers while the gases and vapors at the same time are able to escape from the dosing containers into the pitch reservoir, according to the filling level of the pitch. In the gas-containing space of the pitch dosing containers, a certain overpressure is maintained in this manner during the filling of pitch, which overpressure of course has to be lower than the pressure in the pitch ring conduit 6 established by the circulation pump 7. If it is indicated by the bearing-pressure measuring means 16 that the desired filling level has been reached in the pitch dosing containers, the locking organs 9 and 20 are closed again. The control of the filling procedure as well as the charging of the pitch coke furnaces via the locking organs 24 can easily be automatized. The supply of the furnaces with pitch can be precisely adapted to the instantaneous operational conditions of the furnaces. When the filling level of the pitch dosing containers is going down, over-heated water vapor or an inert gas is fed from the pressure conduits 26 via the pressure regulating valves 27 into the dosing containers, their internal pressure thus being kept constant over the total charging period of the furnaces. Alternatively, the desired filling amount per time unit is regulated by a change of pressure by means of the pressure regulating valves 27 and 28 which establish a pressure reduction. The velocity of the pitch supplied to the furnaces thus is not dependent on the filling height of the pitch in the dosing containers. Once a dosing container has been emptied, the conduit leading to the pitch coke furnace is flushed free of pitch remainders, which might cause an obstruction, by a further supply of steam.

In all the embodiments of the arrangement according to the invention, the pitch dosing containers may be heat-insulated, and the dosing containers of the plant according to FIG. 4 have to be designed pressure-proof.

A plant with pitch dosing containers being under pressure takes into account, to a special extent, the demands for good controllability of the furnace charging with a simultaneous increase in the operational safety. An escape of pitch vapors into the environment is completely prevented in such a closed system.

What I claim is:

1. An arrangement to be used for controlling the quantity and period of charging of pitch coke furnaces, which arrangement comprises a heatable ring conduit, pitch supply conduits connected to said heatable ring conduit and containing controllable locking organs, said supply conduits being directed to said coke furnaces, at least one pitch reservoir being in connection with said heatable ring conduit, pitch dosing containers provided in said pitch supply conduits between said controllable locking organs and said coke furnaces, and bearing-pressure measuring means for mounting said pitch dosing containers and making a determination of the respective filling level of each of said pitch dosing containers, said determination controlling the amount of pitch entering said dosing containers through operation of said locking organs.

2. An arrangement as set forth in claim 1, further comprising movable filling cars upon which said pitch dosing containers with said bearing-pressure measuring means are mounted.

3. An arrangement as set forth in claim 1, further comprising a pressure conduit for conducting steam and a pressure regulating valve provided in said pressure conduit, and wherein each of said pitch dosing containers defines a gas-containing space, said gas-containing space being in connection with said pressure conduit.

4. An arrangement as set forth in claim 1, further comprising a pressure conduit for conducting an inert gas and a pressure regulating valve provided in said pressure conduit, and wherein each of said pitch dosing containers defines a gas-containing space, said gas-containing space being in connection with said pressure conduit.

5. An arrangement as set forth in claim 1, 2, 3 or 4, wherein each of said pitch dosing containers defines a gas-containing space, and which arrangement further comprises:

a vapor tower having a lower section and an upper section, a flushing-water shower provided in said upper section of said vapor tower, and a vapor conduit for connecting said gas-containing space with said vapor tower.

* * * * *